US007828640B2

(12) United States Patent
Liang

(10) Patent No.: US 7,828,640 B2
(45) Date of Patent: Nov. 9, 2010

(54) BLOWER

(75) Inventor: Hesheng Liang, Zhong Shan (CN)

(73) Assignee: Sun Pleasure Company Limited, Hong Kong (HK)

( * ) Notice: Subject to any disclaimer, the term of this patent is extended or adjusted under 35 U.S.C. 154(b) by 0 days.

(21) Appl. No.: 11/398,104

(22) Filed: Apr. 5, 2006

(65) Prior Publication Data

US 2007/0099554 A1 May 3, 2007

Related U.S. Application Data

(63) Continuation-in-part of application No. 11/264,276, filed on Nov. 1, 2005.

(30) Foreign Application Priority Data

Nov. 4, 2005 (CN) ..... 2005 2 0067248

(51) Int. Cl.
*F24F 7/007* (2006.01)

(52) U.S. Cl. ..... 454/76

(58) Field of Classification Search ..... 417/366; 15/405, 330; 454/270, 76
See application file for complete search history.

(56) References Cited

U.S. PATENT DOCUMENTS 3,644,051 A * 2/1972 Shapiro ..... 415/90
5,375,651 A * 12/1994 Colwell ..... 165/47
5,768,749 A * 6/1998 Ohi et al. ..... 15/405
6,099,608 A * 8/2000 Harms et al. ..... 55/400
6,210,109 B1 * 4/2001 Will et al. ..... 415/204
6,231,311 B1 * 5/2001 Gatley et al. ..... 417/53
6,602,058 B1 * 8/2003 Stewart ..... 417/366
6,700,235 B1 * 3/2004 McAfee ..... 310/52
2002/0102165 A1 * 8/2002 Kim ..... 417/310
2003/0077174 A1 * 4/2003 Kim ..... 416/186 R
2003/0190242 A1 * 10/2003 Anderson ..... 417/362
2004/0025810 A1 * 2/2004 Davis et al. ..... 123/41.7
2004/0123482 A1 * 7/2004 Tokuda et al. ..... 34/90

* cited by examiner

*Primary Examiner*—Steven B McAllister
*Assistant Examiner*—Samantha A Miller
(74) *Attorney, Agent, or Firm*—Raymond Sun

(57) ABSTRACT

A blower has an air outlet duct having an internal space, and an air outlet opening extending from the air outlet duct. A fan having a plurality of blades is positioned inside the internal space. A base seat is positioned below the air outlet duct, with an air inlet provided in a side wall of the base seat, and with an air inlet pipe extending from the air inlet. A motor is positioned in the base seat and has a shaft that extends through the air outlet duct to be coupled to the blades.

2 Claims, 1 Drawing Sheet

32
33
300
4
34
30
31
2
101
17
16
18
15
12
19
14
13
1
11

BLOWER

RELATED CASES

This is a continuation-in-part of co-pending Ser. No. 11/264,276, filed Nov. 1, 2005, whose entire disclosure is incorporated by this reference as though set forth fully herein.

BACKGROUND OF THE INVENTION

1. Field of the Invention

The present invention relates to a blower.

2. Description of the Prior Art

A conventional blower typically includes an electric motor, air blades, and a centrifugal air channel. The air blades are oriented vertically in the air channel. The electric motor is positioned on one side of the air channel, and an air inlet is formed at the other side. When the power is turned on, the electric motor drives the air blades to rotate. After the air blades draw in air from the air inlet, the air is blown out through the air outlet of the air channel.

Unfortunately, this configuration for a conventional blower suffers from some drawbacks. One disadvantage of the conventional fan is that the air is drawn from many differents directions into the air inlet, which causes unstable airflow and high noise. In addition, it can only perform the single function of blowing air.

SUMMARY OF THE DISCLOSURE

It is an object of the present invention to provide a blower that overcomes the drawbacks described above.

It is another object of the present invention to provide a blower that facilitates stable air flow and reduces noise.

It is yet another object of the present invention to provide a multifunctional blower.

In order to accomplish the objects of the present invention, the present invention provides a blower that has an air outlet duct having an internal space, and an air outlet opening extending from the air outlet duct. A fan having a plurality of blades is positioned inside the internal space. A base seat is positioned below the air outlet duct, with an air inlet provided in a side wall of the base seat, and with an air inlet pipe extending from the air inlet. A motor is positioned in the base seat and has a shaft that extends through the air outlet duct to be coupled to the blades.

DETAILED DESCRIPTION OF THE PREFERRED EMBODIMENTS

Figure 1:
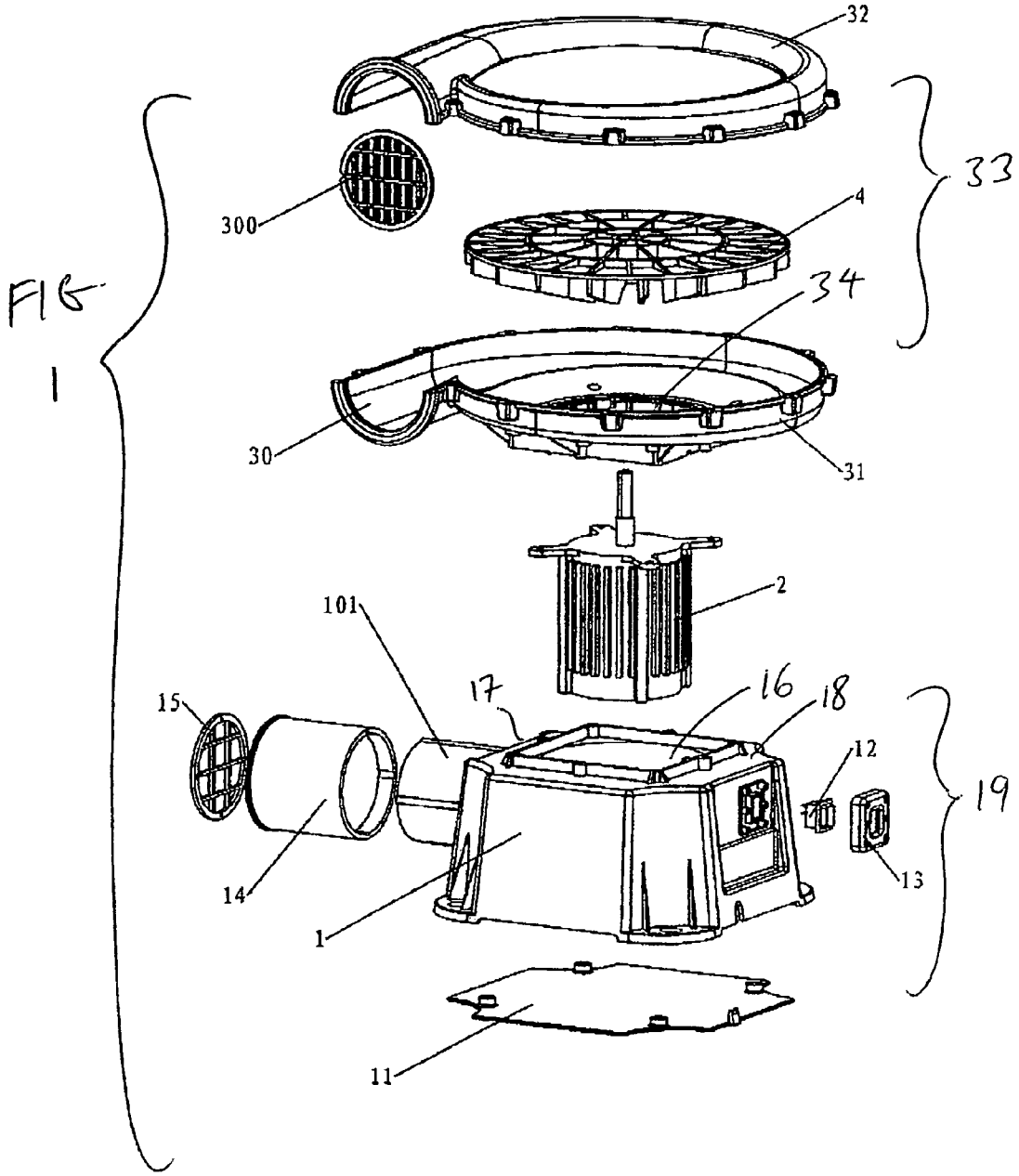
FIG. 1 is an exploded perspective view of a blower according to one embodiment of the present invention.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Referring to FIG. 1, a blower according to the present invention has a base seat 1, an electric motor 2, and a fan that is coupled to the motor 2. The fan can be provided in the form of a rotor having a plurality of blades 4. The motor 2 is retained inside the base seat 1. An air outlet duct 33 is defined by an upper air cover 32 and a lower air cover 31, with the blades 4 positioned in the space defined by the air covers 31 and 32. The air outlet duct 33 has an air outlet opening 30, with an air outlet screen 300 provided thereat. The air outlet duct 33 is positioned above the base seat 1, and has an air inlet opening 34 at about the center of the lower air cover 31.

The base seat 1 has a base plate 11 that functions as a bottom piece, and an air outlet opening 16 that is provided in a top wall 18 of the base seat 1. An air inlet pipe 101 extends from an opening in the side wall 17 of the base seat 1. A sleeve 14 is arranged around the exterior of the air inlet pipe 101. An air inlet screen 15 is fixed at the air inlet opening of the sleeve 14. The air inlet pipe 101, the base seat 1, and the base plate 11 together form an air inlet duct 19. The shaft of the electric motor 2 extends vertically from the air outlet opening 16 of the base seat 1 and is inserted through the air inlet opening 34 of the air outlet duct 33, to be operatively connected to the blades 4. The air inlet opening 34 of the air outlet duct 33 is fluidly connected to the air outlet opening 16 of the air inlet duct 19. A switch 12 is provided on one side of base seat 1, and protected by a switch cover 13.

When the switch 12 is turned on, the electric motor 2 drives the blades 4 to rotate. The air enters the air inlet duct 19 via the air inlet screen 15 and the air inlet pipe 101, and flows through the surface of the electric motor 2. The air then enters the air outlet duct 33 (via the openings 16 and 34) and is fed to the air outlet opening 30 by the blades 4.

The blower of FIG. 1 can be used to perform different functions. For example, to evacuate an article from the interior of the blower (e.g., inside the air inlet duct 19), it is only necessary to connect a pump or vacuum to the air inlet opening of the sleeve 14 using a pipe (not shown). In addition, to blow out a certain gas in a certain direction, it is only necessary to connect the opening of a bottle (not shown) filled with that gas to the air inlet opening of the sleeve 14 using a pipe (not shown). The gas from the bottle can be drawn into the air inlet duct 19, through the air outlet duct 33, and then blown out from the air outlet opening 30, with the amount of gas blown out being controlled by controlling the flow rate in the pipe.

The construction of the blower of the present invention results in the following:

1. Since the air inlet opening of the air inlet duct 19 is concentrated at the opening of the air inlet pipe 101, and the electric motor 2 is sealed inside the air inlet duct 19, the incoming airflow is stable, and the noise is low.

2. It is possible to connect an external air pipe at the opening of the air inlet pipe 101 to extract air from the inside of the air inlet duct 19. It is also possible to connect a bottled gas to the air inlet pipe 101 so that the gas can be blown out through the air outlet opening 30. Thus, the number of functions of the blower is increased.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A method of blowing a gas stored in a bottle, comprising:

a. providing a blower that is supported on a surface, the blower having:

an air outlet duct having a duct housing that defines an internal space, an air inlet opening at a bottom wall of the duct housing, and an air outlet opening extending from the duct housing;

a single fan having a plurality of blades positioned inside the internal space of the duct housing;

a base seat positioned below the air outlet duct, the base seat having a base seat housing that includes a side wall and defines an interior space, with an air inlet provided in the side wall, an air outlet opening provided at a top wall of the base seat housing, and an air inlet pipe extending externally out of the side wall from the air inlet; and a motor positioned in the base seat housing and having a single shaft that extends through the duct housing to be coupled to the blades;

wherein the internal space of the duct housing is separate and distinct from the interior space of the base seat housing, further including an air flow path where air enters from the air inlet into the interior space of the base seat housing, out through the air outlet opening of the base seat housing, then through the air inlet opening of the duct housing into the internal space of the duct housing, and then exits the duct housing through the air outlet opening of the duct housing;

b. coupling the bottle to the air inlet pipe;

c. drawing the gas from the bottle through the air inlet pipe;

d. passing the drawn gas through the motor before delivering the gas to the air outlet duct; and e. directing the air from the air outlet duct out of the air outlet opening.

2. The method of claim 1, further including:

controlling the rate at which the gas flows through the air inlet pipe.

* * * * *